United States Patent [19]

Schutt et al.

[11] 4,442,903

[45] Apr. 17, 1984

[54] SYSTEM FOR INSTALLING CONTINUOUS ANODE IN DEEP BORE HOLE

[76] Inventors: William R. Schutt, R.D. 5, Curley Hill Rd., Doylestown, Pa. 18901; Stephen R. Booth, 13835 Cherry Hollow La., Houston, Tex. 77082

[21] Appl. No.: 389,195

[22] Filed: Jun. 17, 1982

[51] Int. Cl.[3] ..... E21B 19/08

[52] U.S. Cl. ..... 166/385; 166/65 R; 204/196; 254/134.3 FT

[58] Field of Search ..... 166/385, 382, 65 R, 166/248, 244 C, 77; 254/134.3 FT; 204/196, 147, DIG. 6; 242/99, 156, 147 R; 188/65.4; 226/195

[56] References Cited

U.S. PATENT DOCUMENTS

| | | | |
|---|---|---|---|
| 2,326,556 | 8/1943 | Opsal | 166/65 R |
| 2,916,429 | 12/1959 | Vossnack et al. | 204/196 |
| 3,250,515 | 5/1966 | Hudnall et al. | 188/65.4 |
| 3,276,747 | 10/1966 | Zimmerman | 242/99 X |
| 3,458,643 | 7/1969 | Dorr | 174/6 |
| 3,725,669 | 4/1973 | Tatum | 204/196 |
| 4,056,446 | 11/1977 | Vennett | 204/1 |
| 4,089,767 | 5/1978 | Sabins | 204/197 |
| 4,170,532 | 10/1979 | Tatum | 204/196 |
| 4,251,343 | 2/1981 | Peterson et al. | 204/197 |
| 4,307,783 | 12/1981 | Lanmon | 166/77 X |

*Primary Examiner*—Ernest R. Purser
*Assistant Examiner*—Thuy M. Bui
*Attorney, Agent, or Firm*—Caesar, Rivise, Bernstein & Cohen, Ltd.

[57] ABSTRACT

A method and apparatus for installing continuous anodes in deep bore holes in order to cathodically protect underground metal structures situated adjacent said bore holes. The system is readily adapted to be used with either replaceable or non-replaceable deep anode assemblies. A continuous anode and at least one associated flexible continuous coiled component are wound around reel means which are mounted adjacent the mouth of the bore hole. Attached to the free end of the component and the anode is a weighted base member which when located in the bore hole pulls the continuous anode and the other continuous component to the bottom of the bore hole. Lowering means are provided to insure that the weight means descend to the bottom of the bore hole at a controlled rate of speed. The lowering means includes a rope which is attached at one end to the weight means and at its other end is wound about a spool and a cylindrical member in a manner whereby the frictional engagement between the rope and the cylindrical member controls the rate with which the rope unreels and the rate with which weight means is able to descend toward the bottom of the bore hole. The system is contained in a housing which serves as means for transporting as well as supporting the system. The housing is constructed as a crate member having a door. The weight means is dropped through the door when open and into the bore hole for installation therein.

24 Claims, 9 Drawing Figures

FIG. 3
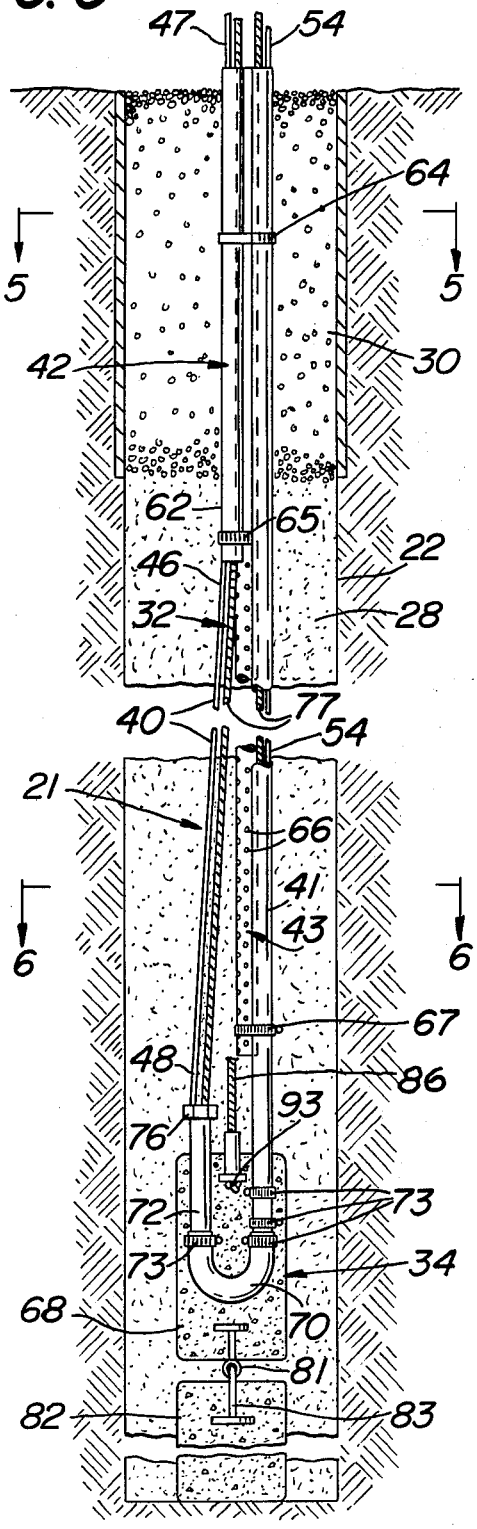
FIG. 4
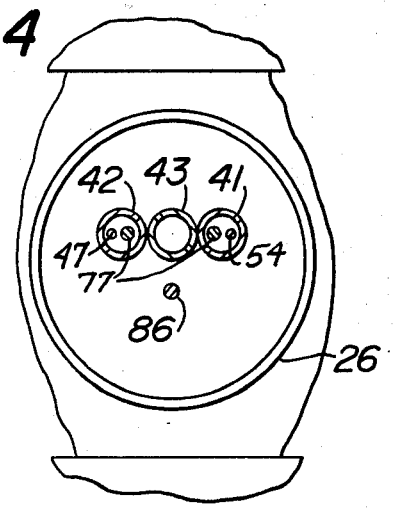
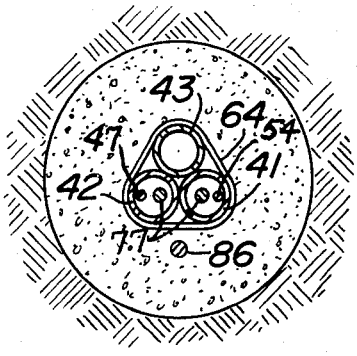
FIG. 5
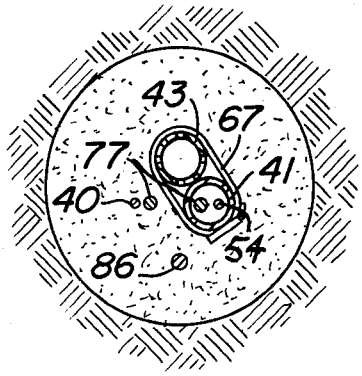
FIG. 6

SYSTEM FOR INSTALLING CONTINUOUS ANODE IN DEEP BORE HOLE

BACKGROUND OF THE INVENTION

This invention relates generally to cathodic protection systems, and particularly, to impressed current cathodic protection systems.

In order to protect varied metal structures, such as pipelines, power cables, underground transformers, etc., it is a common practice to use cathodic protection systems. One type of cathodic protection system is called an impressed current system and operates by neutralizing the galvanic current produced in the burial medium, usually the ground, and the structure to be protected. One type of impressed current system is known as a rectifier-ground bed installation. In a common type of rectifier-ground bed installation, an external source of potential is provided to a buried anode, via an existing AC power supply (although the power can be provided via other means, such as, for example, gas driven generators, etc.). Coupled to the AC power supply is a rectifier whose positive terminal is connected to a string of anodes, which are referred to as the ground bed, and which are buried adjacent the structure bed. The negative terminal of the rectifier is connected to the structure. In common practice, the anodes of the ground bed can be connected in any number of configurations, e.g., series, parallel, etc., and are commonly formed of various materials, such as graphite, carbon, silicon, iron, etc.

The efficacy of ground bed systems is a function of the resistivity of the soil in which the anodes are buried, the number of anodes, the spacing between anodes, the distance to the buried structure, etc. For example, the higher the ground resistivity, the greater the number of anodes required to cover a desired area. Inasmuch as the resistivity of the soil is usually lower at greater depths, it is a common practice to dispose the anodes at substantial depth, e.g., 100 or more feet, below the surface. At such depths, the soil tends to be less resistive due to its compositional makeup and/or the presence of water. Depending upon the application, deep bed anodes can be disposed at depths from 100 feet (30.5 m) to 800 feet (244 m) or more, with 150 feet (45.8 m) being average.

Various deep anode bed systems have been disclosed in the patent literature. For example, in U.S. Pat. No. 3,725,669 (Tatum), there is disclosed an impressed current, deep anode bed, cathodic protection system. That system makes use of a long tube extending down the bore hole and in which tube one or more anodes are suspended. The bore hole is filled with a granular, electrically conductive material, e.g., coke breeze, so that the current from the anode spreads out radially therefrom.

While the system of the Tatum patent appears generally suitable for its intended purposes, it is somewhat complex in structure and provides only limited means for the replacement of any of its anodes in the event of anode failure or preventive maintenance.

Likewise, prior art deep anode bed cathodic protection systems in general, also suffer from various disadvantages, such as complexity, cost, ability to replace anodes expeditiously, etc.

To that end, a preferred type of deep anode assembly having an anode and conductors constructed to be readily replaceable after being installed within the bore hole was invented and is disclosed and claimed in co-inventor William Schutt's co-pending U.S. patent application Ser. No. 293,900 filed on Aug. 18, 1981, whose disclosure is incorporated by reference herein. That assembly shall be referred to hereinafter as a replaceable deep anode assembly.

The replaceable deep anode assembly disclosed and claimed in the above mentioned co-pending patent application is installed within a deep bore hole by connecting together successive sections of conduit as the assembly is lowered into the bore hole. While this method is satisfactory from a functional standpoint, it is clearly desirable to provide a means for facilitating the installation of a deep anode assembly.

OBJECTS OF THE INVENTION

Accordingly, it is a general object of the instant invention to provide an apparatus and method of installing a deep anode assembly which overcomes the disadvantage of the prior art.

It is another object of this invention to provide an apparatus and method for installing a replaceable or non-replaceable anode assembly in a bore hole.

It is another object of the invention to provide a system for installing an anode assembly in a bore hole which is simple in construction and easy to use.

It is a further object of the invention to provide an integrated system for transporting an anode assembly to the site of a bore hole and for effecting the installation of said anode assembly into the bore hole in a quick, easy and effective manner.

SUMMARY OF THE INVENTION

These and other objects of the instant invention are achieved by providing a system for installing an anode assembly in a bore hole to cathodically protect underground metal structures. The system includes both a method and an apparatus used in the method. The apparatus basically comprises reel means and an anode assembly having a first end. The assembly includes an electrically conductive elongated anode and an associated, flexible, continuous coiled component. In that regard, weight means is attached to the assembly adjacent its first end. The system further includes support means for supporting the reel means in a manner such that when the weight means is dropped into the bore hole the weight means descends to the bottom of the bore hole and the anode and the component unreel from the reel means until the first end of the assembly reaches the bottom of the bore hole.

DESCRIPTION OF THE DRAWING

Other objects and many of the attendant advantages of this invention will be readily appreciated as the same becomes better understood by reference to the following detailed description when considered in connection with the accompanying drawing wherein:

FIG. 3 is a side elevational view, partially in section, of the bore hole showing the anode assembly of FIG. 1 after installation is complete;

FIG. 4 is an enlarged sectional view taken along line 4—4 of FIG. 1;

FIG. 5 is an enlarged sectional view taken along line 5—5 of FIG. 3;

FIG. 6 is an enlarged sectional view taken along line 6—6 of FIG. 3;

DETAILED DESCRIPTION OF THE PREFERRED EMBODIMENT

Figure 1:
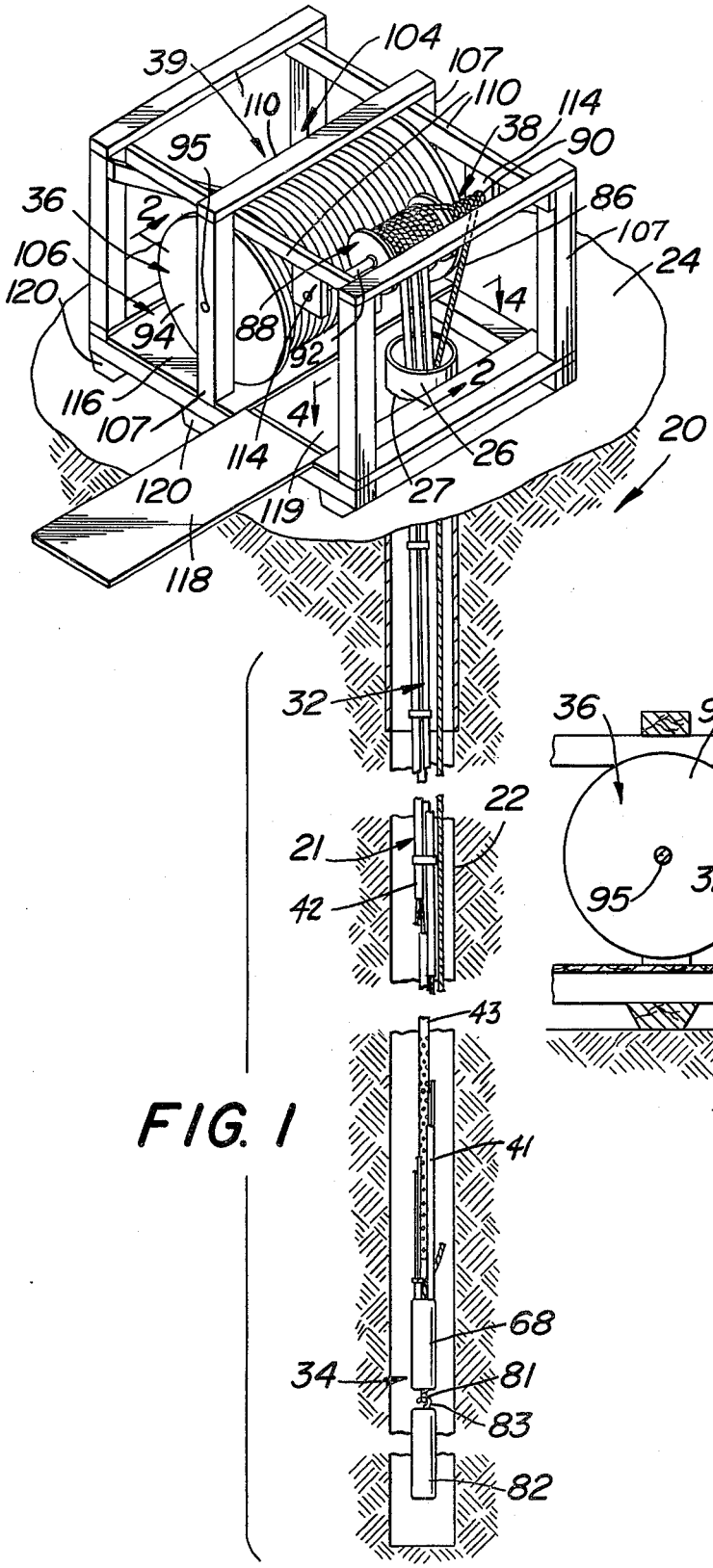
FIG. 1 is a perspective view, partially cut away, of a replaceable anode assembly being installed in a bore hole using the method and the apparatus of this invention.

Referring now in greater detail to the various figures of the drawing wherein like reference numerals refer to like parts, there is shown in FIG. 1 a replaceable, deep bed anode installation system 20 for installing a replaceable anode assembly 21 into a deep bore hole 22 of an impressed current cathodic protection system. The system 20 includes apparatus (to be described later) and the anode assembly 21 which are constructed in accordance with one aspect of this invention and is installed within a deep bore hole 22 in accordance with another aspect of this invention.

The cathodic protection system in its entirety is arranged to provide cathodic protection to buried, corrosion-prone structures, e.g., pipelines, etc., (not shown). The cathodic protection system itself is conventional and basically comprises a rectifier/controller unit (or some other source of current) mounted above ground at a remote location from the anode bed, but connected thereto, via its positive terminal. The anode assembly, is disposed within the bore hole 22 in the ground 24 adjacent the structure to be protected. The negative side of the rectifier or current source is connected to the buried structure to complete the impressed current path.

Figure 7:
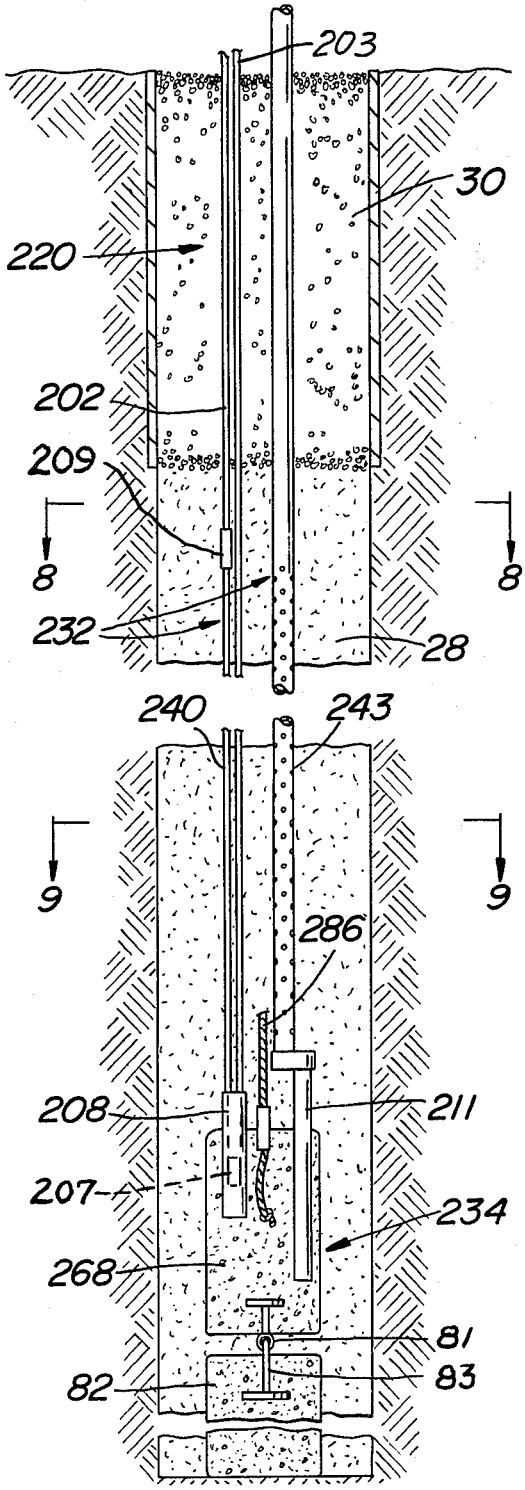
FIG. 7 is a side elevational view, similar to that of FIG. 2 but showing the completed installation of a non-replaceable anode assembly constructed in accordance with this invention.
Figure 8:
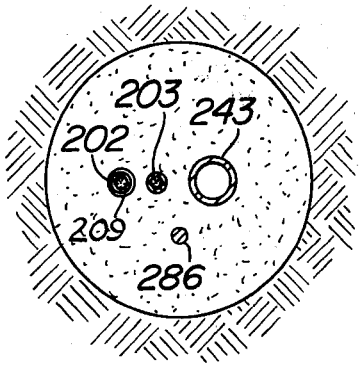
FIG. 8 is an enlarged sectional view taken along line 8—8 of FIG. 7.
Figure 9:
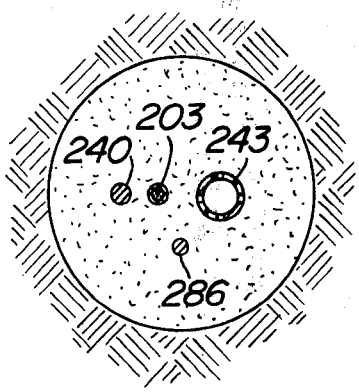
FIG. 9 is an enlarged sectional view taken along line 9—9 of FIG. 7.

The method and the apparatus for installing continuous anodes in deep bore holes as disclosed and claimed in this application is suitable for installing either a replaceable anode assembly 21 (as shown in FIGS. 1–6 of the drawing) or a non-replaceable anode assembly 220 (as shown in FIGS. 7–9 of the drawing) into a deep bore hole 22.

The system 20, shown in FIG. 1, includes not only the anode assembly 21 but also the means for transporting the anode assembly to the site of the bore hole 22 and for installing the anode assembly in the bore hole. Thus, system 20 includes means (to be described later) for lowering a generally pre-assembled continuous anode and continuous conduit means into the bore hole 22.

As shown in FIG. 3 the bore hole 22 is formed by conventional drilling techniques and can extend from 100 to 800 or more feet below the surface. The diameter of the bore hole is approximately 8 inches (20.3 cm). At the mouth 27 of the bore hole there is located a conventional steel casing 26 to prevent the overburden from collapsing in the bore hole. An electrically conductive, granular material, such as coke breeze 28, is disposed within the hole.

The use of coke breeze 28 in deep well anode beds is conventional to expedite the passage of impressed current from the anode to the buried structure. The coke breeze 28 is located within the hole for a substantial portion of the depth, which portion is a function of the ground resistance, ground water content, number of anode beds, location of the underground structure, etc. The interior of the bore hole above the coke breeze level is back filled with gravel 30 (FIG. 2) or some other loose fill. The gravel 30 may extend for a depth up to several hundred feet, again depending upon the application.

Referring to FIG. 1, the assembly 20 basically comprises an anode and associated conduits which form a subassembly 32, a bottom subassembly 34, reel means 36, lowering means 38 and a crate/support assembly 39. The subassembly 32 and subassembly 34 make up the anode assembly 21 proper. The anode and conduit subassembly 32 is unreeled from the reel means 36 in order to be lowered into the bore hole, with the bottom subassembly 34 being secured to a free end of the anode and conduit subassembly 32.

The lowering means 38, which includes a rope to be described later, provides the means for lowering the anode assembly fully into the bore hole 22 at a controlled rate of speed. When the anode assembly is completely in the bore hole the bottom assembly is at the bottom of the hole.

Prior to installation, the entire anode assembly is mounted and contained within the crate/support assembly 39. This assembly provides ready means for transporting the system to the bore hole and also serves as support means for both the reel means 36 and the lowering means 38 during the installation process.

The preferred embodiment of the anode assembly 21, as shown in FIGS. 1 and 3, is a replaceable type, continuous, dual-feed anode 40 (such as the one disclosed and claimed in the above mentioned co-pending patent application) and associated conduit means 41, 42 and 43 (to be described later). As can be seen in FIG. 3, the anode 40 is "continuous" in that it comprises an elongated wire extending substantially the entire length of the portion of the bore hole 22 in which the coke breeze 28 is located. The wire is formed of any suitable material, such as niobium, tantalum, titanium, etc., and is preferably coated with platinum.

The anode 40 includes an upper end 46 and a lower end 48. The upper end 46 is electrically connected to a flexible electrical conductor or cable 47 at a splice joint (not shown) and the lower end 48 of the anode 40 is connected to an electrical conductor or cable 54 at a second splice joint (also not shown). The cables are preferably insulated. The splices at the joints can be effected in any conventional manner, such as by soldering, crimping, etc. A waterproof insulating material is preferably placed over the splice by various conventional techniques, e.g., by use of a heat shrinkable plastic sleeve. It should be pointed out that the foregoing is done prior to installation, preferrably at some remote location (i.e., at a factory).

As clearly shown in FIG. 3, the subassembly 32 (i.e., anode 40 and associated cables 47 and 54), when located in the bore hole, is disposed in a generally U-shaped configuration. In this configuration, the anode 40 is located approximately centrally throughout the entire coke breeze portion (column) of the bore hole. The conductor 47 extends upward from the anode 40, through the conduit means 42 to the top of the bore hole for electrical connection to the positive terminal of the current source which is disposed remotely from the anode. The other conductor 54 extends through the bottom assembly 34 and back up through the conduit means 41 to the top of the bore hole for electrical connection to that same terminal of the current source.

The conduits 41 and 42 and the bottom subassembly 34 serve as means for holding the anode 40 in position as just described, with the anode itself being in direct electrical continuity with the coke breeze and located radially in the center of the bore hole. This arrangement facilitates the replacement of the anode or the conductors if such is required.

The conduit means 41, 42 and 43 each comprise a continuous length of flexible, tubing which is readily either reeled or unreeled from the reel assembly 36 as desired (and as shall be described in detail later). The tubing is formed of a tough, yet flexible, corrosion resistant material, such as a plastic. Several particularly effective plastics include polyethylene, polyvinyl chloride (PVC) and acrylonitrile-butadiene-styrene (ABS).

It should be pointed out that by using conduit means 41, 42, and 43 which are each constructed of a continuous length of flexible tubing (as opposed to each being constructed from a plurality of discrete conduit sections arranged to later be assembled at the bore hole site as disclosed in the aforementioned copending application), the replaceable anode subassembly 32 is able to be preassembled at a factory or at some other remote location prior to its being transported to the bore hole site. Thus, the on-site installation of the subassembly 32 in the deep bore hole basically involves the lowering of the preassembled anode subassembly 32 into the bore hole, connecting the anode to the electrical source and then filling the remaining portion of the bore hole with coke breeze 28 and gravel 30 as shall be described in greater detail later.

The conduit means 41 is sufficiently long to extend from the surface 24 of the bore hole to the bottom assembly 34 located at the bottom of the bore hole. The conduit means 42 is in the form of a chute of a shorter predetermined length. The chute 42 is mounted adjacent the uppermost portion of the assembly 21 contiguous with the mouth 27 of the bore hole. The chute 42 extends the full depth of the gravel-filled section 30 of the bore hole and slightly into the coke breeze 28 column. The chute 42 is made up of a continuous length of flexible tubing whose length is selected to accommodate the construction (e.g., depth) of the bore hole 22 and anode 40 being used. In a typical installation, the lower end 62 of the chute 42 extends a short distance (e.g., 2 feet) into the coke breeze 28.

The chute 42 is secured to conduits 41 and 43 via the use of a rigid jumper strap 64 and a clamp 65 (as best shown in FIGS. 3 and 5). The strap 64 is secured about the three respective conduit members by a suitable adhesive (not shown). The clamp 65, and a second similar clamp 67, serve to hold conduit 42 to conduit 43 and conduit 41 to conduit 43, respectively, as mentioned above, with the result being that all three conduit members are held together as a single bundle, as shown in FIGS. 3 and 5.

Although the longitudinal axes of all three conduits 41, 42 and 43, respectively, comprising the bundle, are disposed parallel and colinear to one another while coiled about the reel means 36 as shown in FIG. 4, once the conduits are uncoiled and lowered into the bore hole, the clamp means 65 and 67 and the strap means 64 cause them to bunch together in a triangular-like configuration like that shown in FIG. 5.

The conduit means 43 is arranged to vent gases produced during anode operation to the ambient atomosphere at the mouth 27 of the bore hole. Thus, the conduit means 43 extends substantially the full length of the bore hole. The conduit means 43 is constructed similarly to conduit means 41, except that conduit means 43 includes a multitude of perforations 66 in the portion thereof extending through the coke breeze column of the bore hole. The perforations enable gases produced in the coke breeze column to pass into the conduit. The unperforated portion of the conduit means 43, extends through the gravel or fill 30.

The clamps 65 and 67 which secure the conduit means together are conventional hose type clamps and are attached to the respective conduit portions when the system 20 is preassembled (e.g., at the factory). Likewise, the strap 64 is secured around the three conduits at that same time.

The details of the bottom subassembly 34 can best be appreciated by reference to FIG. 3. Thus subassembly 34 basically comprises a cylindrically shaped weighted base member 68 and an auxiliary weight 82 to be described later. The base 68 is a generally cylindrical member, preferably formed of concrete to keep it from floating up in the event that there is water in the bore hole, (a common occurrence), and to prevent the assembly from snagging as it is lowered into the bore hole. The base member 68 also includes a generally U-shaped conduit section or elbow 70 embedded therein and whose ends are open and extend upwardly through the top surface of the member 68. A short upwardly projecting tubular stub section 72 is connected to one open end of the elbow, while the other open end of the elbow is connected to conduit means 41 through the use of conventional clamping means 73 (e.g., conventional hose clamps). Clamps 73 also serve to hold conduit means 41 securely in place within the base member 68.

The elbow 70 serves as means for directing a 180° directional change in the anode assembly and connected conductor to enable the downwardly extending portion of these members to be directed upward and back to the top of the bore hole.

Thus, the conduit means 41 and 42 serve as the means for holding the anode 40 within the bore hole at its desired central position and for providing a clear, low friction path through the bore hole for the anode and connected conductors to pass, respectively, to enable ready replacement of these members without having to dig up or remove the entire assembly 20.

The anode 40 and associated cables are located as follows: The upper conductor or cable 47 extends through the chute 42 and out the top thereof for electrical connection to the positive side of the rectifier. The upper splice (not shown) is disposed within the conduit 42, slightly above its bottom end 62. Since the bottom end 62 of the chute extends slightly below the top of the coke breeze 28 column in the bore hole, the splice is isolated from the coke breeze. The anode 40 extends downward through the coke breeze column and enters into the top of the short stub conduit 72 of the base assembly 34. The short stub conduit section 72 is located slightly laterally of the longitudinal axis of conduit 42, but the offset is so slight as compared to the length of the anode that for all intents and purposes the anode is centered within the coke breeze column of the bore hole when the base assembly is in its normal position as shown in FIG. 3. The splice (not shown) at the lower end 48 of the anode 40 is located within the stub section 72, with the conductor 54 extending downward, through the U-shaped elbow 70, upward into the conduit means 41 and up therethrough to the surface for electrical connection to the other conductor and hence to the positive anode of the rectifier 56.

The isolation of the upper splice from the coke breeze minimizes the chances of corrosion at the splice. Since the lower splice is located within the upwardly extending stub 72 of the base assembly, and hence is subject to contact with the coke breeze which would otherwise fall therein, a seal 76 is provided to close the open end of the stub 74 about the periphery of the anode, thereby precluding the ingress of coke breeze into the bottom assembly and into contact with the splice.

As shown clearly in FIG. 3 guide means 77 are provided to serve as a back up mechanism for effecting replacement of an anode assembly in the event of a break in the conductors, the splices or in the event that the primary anode replacement method (as described in said co-pending patent application) is not desired or is unavailable. The guide means 77 basically comprises a rope, which extends parallel to the subassembly 32 and is threaded through the conduits in the same manner as the anode and connected cables. The rope 77 is preferably formed of a man-made material which is resistant to Chlorine. The rope 77 is attached to the subassembly 32 by a plurality of conventional, encircling ties (not shown).

As will be appreciated from the foregoing, the conduits 41 and 42 through which the anode, the connected cables and the guide means pass provide a clear, unobstructed, low friction path through the bore hole. Thus, a replacement anode assembly can be readily threaded into position, unimpeded by the material filling the hole. Moreover, the conduits effect the centralization of the exposed anode within the the coke breeze column.

The perforations 66 in the vent conduit 43, in addition to enabling Chlorine or other gas generated during operation of the cathodic protection system to pass from the coke breeze into the conduit 43 and up to the surface, also provide means for effecting fluidization of the coke breeze, when such action is desired.

As can be seen in FIG. 3 an eyelet 81 is secured to the bottom surface of the weighted base 68 to enable the additional weighted member 82 to be attached thereto. The weighted member 82 is a cylindrical concrete body having a conventional hook 83 secured thereto. This hook enables the member 82 to be attached to the eyelet 81 of the base just prior to the installation of the anode assembly into the bore hole. By virtue of the separateness of the weights ease of handling of the system prior to installation is enhanced.

The lowering means 38 for lowering the anode assembly into the bore hole is shown in FIG. 1 and basically comprises a rope 86, a rotatable spool 88 and a rope brake 90. The rope 86 is constructed of a conventional high-strength, preferably man-made material. A first end of the rope is wound around the rotatable spool 88. The spool 88 is enabled to rotate about a stationary shaft 92 which is fixedly mounted in the crate/support assembly 39. An intermediate portion of the rope is wound around a portion of a stationary shaft 92 to form the rope brake 90. The second or free end of the rope is secured to a connector 93 which is embedded in the upper portion of the base member 68, at the center thereof. Since the shaft 92 is fixed the frictional engagement between the encircling winds of rope provide braking action as the rope unreels from spool 88, thus preventing the anode assembly from descending to the bottom of the bore hole too quickly. The rate of descent is partially a function of the number of times the rope 86 is helically wound about the brake member 90 and consequently, by varying the number of times the rope is wound as such, the rate of descent can readily be varied as desired. In addition, the rate of speed with which the assembly descends through the bore hole is also varied by increasing or decreasing the weight of the bottom assembly 34. This is readily accomplished by varying the weight of the weight member 82 being used.

The reel assembly 36 (which prior to installation contains the coiled anode and conduit subassembly 32) comprises a spool 94 which is rotatably mounted on an axle 95 mounted on the frame making up the crate/support assembly 39 at a position generally adjacent and above the mouth 27 of the deep bore hole when the crate/support assembly 39 is properly positioned adjacent the bore hole. The three conduits 41, 42 and 43 which are joined together by strap and clamp means to form a single bundle as mentioned above, remain wound around the spool until such time that the assembly 32 is to be lowered into the bore hole.

Although as mentioned above, the auxiliary weighted member 82 is usually connected to the base member 68 at a time just prior to installation into the bore hole, it can alternatively be connected to the base at any other time prior to installation, as well. Moreover, it should be pointed out that the bore hole is readied to receive the assembly 20 by being flushed of all debris prior to the assembly 32 being lowered therein.

Thus, as can readily be appreciated from the foregoing, when the bottom assembly 34 is dropped into the mouth of the bore hole, the spool 94 rotates about the axle 95 enabling the anode assembly 21 to unreel from the spool. As a result, the assembly descends toward the bottom of the bore hole. As mentioned above, the rope 86 unreels from its spool 88 at a rate of speed which is regulated by the frictional engagement between the rope 86 and the rope brake shaft 92. Thus, since the bottom assembly 34 is connected to the free end of the rope 86, the anode assembly descends at a controlled rate of speed down the hole. The likelihood of the bottom assembly being damaged from shock of impact with the bottom of the bore hole during the installation process is thus substantially reduced.

The crate/support assembly 39 not only serves as the support for both the reel assembly 36 and the lowering means 38 but also serves as means for enclosing the system to enable its transportation to the deep bore hole site. In addition the crate/support serves as means for securely situating the system adjacent and in alignment with the mouth 27 of the deep hole, to thereby facilitate the installation process.

Thus, as shown in FIG. 1, the crate/support assembly 39 comprises a frame-like structure having an upper portion 104 and a bottom portion 106. Slats or panels (not shown) cover the frame to form an enclosed crate. The upper portion of the frame is made up of vertical posts 107 and horizontal beams 110. The vertical posts 107 are connected at one end to the bottom portion 106 and at their opposite end to the interconnecting horizontal beams 110. The panels are secured to the frame by conventional means, e.g. nails or screws.

The axle 95 of the spool 94 is mounted between an opposed pair of posts 107 which respectively, are situated at a generally central location within the frame. The shaft 92 is fixedly secured between mounting blocks 114 which extend downward from respective beams 110.

The bottom portion 106 of the crate/support assembly comprises a permanent floor section 116, a removeable floor section or door 118, as well as a plurality of skids 120.

The door 118 is situated adjacent and generally tangentially below a peripheral portion of both the spool 88 and the brake means 90, respectively, from which the free ends of the anode and conduit assembly 32 and the lowering rope 86, respectively, extend. The door is a generally planar member which is readily opened by removing conventional self-tapping screws (not shown). This enables the door to slide open in a direction generally coplanar with the bottom surface 106 of the crate member 39, which in turn enables the bottom assembly 34 and the attached anode and conduit subassembly 32 to be lowered therethrough into the deep bore hole.

Thus in use, the crate assembly is situated adjacent the mouth of the deep bore hole, with its door section 118 situated thereover. By sliding the door open the bottom assembly 34 can pass through the door opening 119 and into the deep bore hole 22. This in turn causes the spools 88 and 94 to rotate unwinding the anode and conduit subassembly 32 and the lowering rope 86 therefrom, respectively.

Thus, it should readily be appreciated that prior to the anode assembly being installed within the bore hole, the door 118 prevents the bottom weight from passing therethrough and the anode subassembly and rope, respectively, from prematurely unwinding from their respective spools.

After the anode assembly has been lowered (e.g., drops) into the bore hole as described above the coke breeze is then pumped into the bore hole, via a pipe (not shown), until it fills to the desired depth of the hole, that is to a height slightly above the bottom 62 of conduit 42. The remainder of the hole is then filled to ground level with gravel 30 or other loose back fill.

The anode subassembly 32 is then ready for connection to the rectifier (not shown) which is accomplished by connecting the two conductors 47 and 54 together and to the positive side of the rectifier, via means (not shown).

The vent conduit 43 is secured above the ground 24 in a manner enabling the gas passing through the tube to vent through its top to the surrounding ambient atmosphere.

An alternative embodiment of the system of this invention entails a method and apparatus for installing a non-replaceable deep anode assembly 220, in a deep bore hole as shown in FIGS. 7–9. To that end, the crate/support assembly 30 shown in FIG. 1 is also utilized in combination with the system shown in FIGS. 7–9 for installing the non-replaceable anode assembly. The non-replaceable deep anode assembly is somewhat similar to the replaceable deep anode assembly except that only the vent conduit is utilized. Thus the anode 240 and the conductors 202 and 203, respectively, are not enclosed in conduit means, but instead extend directly through the deep bore hole cavity to the bottom assembly 234.

The system of this embodiment thus includes a continuous anode 240 and a continuous flexible vent pipe 243 both of which are coiled about the spool 94 (FIG. 1). At their free end, these members are connected to a bottom assembly 234 in a manner similar to the embodiment of FIG. 1. Since the anode 240 is not replaceable, the weighted base member 268 of the bottom assembly does not include the U-shape conduit member. Thus, the lower end of the anode 240 and the lower conductor or cable 203 in the embodiment shown in FIG. 7 are spliced together at a joint 207 which is secured within a short tubular stub 208. The upper conductor or cable 202 is connected to the upper end of the anode 240 at a splice joint 209. The tubular stub 208 is securely embedded in the bottom assembly 234. The vent pipe 243 is secured to the top of another tubular stub 211. The bottom of stub 211 is also securely embedded in concrete of the bottom assembly 234.

A lowering rope 286 is also attached to the base member 268 in a manner similar to that which was described for the replacable anode system.

Another difference between the non-replaceable anode embodiment and the replaceable anode embodiment is that in the former the vent pipe 243, the anode 240 and the conductors 202 and 203 are not strapped or clamped to one another at points situated within the bore hole (see FIGS. 8 and 9), notwithstanding the fact that these members are all connected to the bottom assembly 234 in the manner described above.

Figure 2:
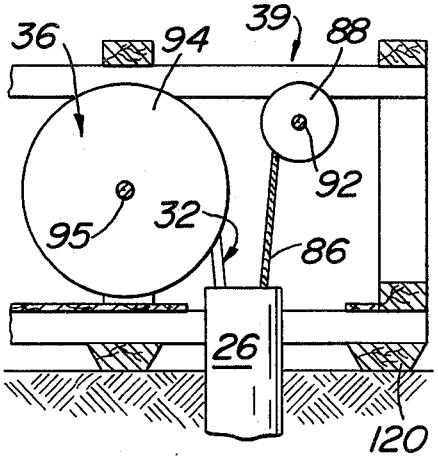
FIG. 2 is an enlarged sectional view taken along line 2—2 of FIG. 1.

A crate/support assembly 39, shown in FIGS. 1 and 2, is utilized for purposes of housing and installing the non-replaceable deep anode assembly 232 in essentially the same manner as it is used for installing the replaceable deep anode assembly therein.

Thus, notwithstanding the structural differences between the replaceable and non-replaceable deep anode assemblies themselves, the system disclosed and claimed herein is equally applicable for being used for installing non-replaceable anodes as it is for installing replaceable ones.

Without further elaboration the foregoing will so fully illustrate our invention that others may, by applying current or future knowledge, readily adapt the same for use under various conditions of service.

We claim:

1. A system for installing an anode assembly for a cathodic protection system in a deep bore hole, said anode assembly having a first end, said system comprising reel means, support means for said reel means to enable a coiled continuous anode and at least one associated coiled component to be unreeled into said bore hole together as a single assembly, and weight means secured to said assembly adjacent its first end for assisting in the carrying of said component and said anode to the bottom of said bore hole.

2. The system of claim 1, further comprising lowering means which provides means for dropping said weight means to the bottom of said bore hole at a controlled rate of speed.

3. The system of claim 2, wherein said lowering means comprises feeder means and a rope having a first end and a second end with said first end being attached to said weight means and said second end being coupled to said feeder means in a manner which serves to regulate the rate of speed with which said weight means descends to the bottom of said bore hole.

4. The system of claim 3, wherein said feeder means comprises a spool and a brake member, said brake member operating to limit the speed with which said rope unreels from said spool.

5. The system of claim 4, wherein said brake member comprises a generally cylindrical rod around which a portion of said rope is wound.

6. The system of claim 1, wherein said reel means comprises a generally cylindrical spool connected to said support structure in a rotatable manner.

7. The system of claim 1, wherein said support structure comprises a housing having a door section such that, when said door section is closed said housing provides ready means for transporting said system and when said door section is open with said assembly being situated adjacent said bore hole, said weight means, said anode and said component drop therethrough into said bore hole.

8. The system of claim 1, wherein said weight means includes a releasably securable weighted member.

9. The system of claim 1, wherein said coiled component comprises a perforated vent pipe for channeling gas from said bore hole to the surrounding ambient atmosphere adjacent said bore hole.

10. The system of claim 9, further comprising a second coiled component situated adjacent and generally parallel to said first component, said second component is unreeled from said reel means into said bore hole into said first component.

11. The system of claim 10, wherein said second component is a generally hollow member containing conductor means therein, said second component providing means for enabling said anode and said conductor means to be readily removed when desired.

12. The system of claim 11, further comprising a third coiled component situated adjacent said first and said second components and extending from a point adjacent the mouth of said bore hole to a point adjacent the top end of said anode wherein said third component is unreeled from said reel means into said bore hole with said other components to further facilitate removal of said anode and said conductor means.

13. The system of claim 1, wherein said support means and said reel means are both disposable so as to be readily discarded once said anode assembly is installed in said bore hole.

14. To cathodically protect underground metal structures, a method for installing an anode assembly having a first end in a deep bore hole, said assembly further includes a continuous electrically conductive, elongated anode and an associated continuous, flexible component wherein said method comprises coiling said anode and said component around reel means which is rotatably mounted to support means, attaching weight means to said assembly adjacent its first end, situating said support means adjacent the mouth of said bore hole and dropping said weight means into said bore hole, said weight means thus descends to the bottom of said bore hole, causing said anode and said associated coiled component to unreel from said reel means together as a single assembly, with the first end of said assembly also descending toward the bottom of said bore hole.

15. The method of claim 14, further comprising the step of attaching a first end of a rope to said weight means and coupling the opposite end of said rope to feeder means to regualte the speed with which said first end and thus said weight means passes through said bore hole.

16. The method of claim 14, further comprising the step of filling said bore hole with electrically conductive material from the bottom of said bore hole to a first point in said bore hole.

17. The method of claim 14, wherein said reel means is contained in a housing having a door and said installation includes the dropping of said weight means through said door and into said bore hole.

18. The method of claim 14, further comprising the step of attaching a releasably securable weighted member to said weight means prior to lowering said assembly into said bore hole.

19. The method of claim 14, further comprising the step of coiling a second component around said reel means such that said second component unreels from said reel means into said bore hole along with said first component and said anode.

20. The method of claim 19, further comprising the step of coiling a third component around said reel means such that said third component also unreels from said reel means into said bore hole along with said first and said second components and said anode.

21. A system for installing an anode assembly for a cathodic protection system in a deep bore hole, said anode assembly having a first end, said system comprising reel means, support means for said reel means to enable a coiled continuous anode and an associated coiled component to be reeled into said bore hole and weight means secured to said assembly adjacent its first end for assisting in the carrying of said component and said anode to the bottom of said bore hole, wherein said coiled component is a perforated vent pipe for channeling gas from said bore hole to the surrounding ambient atmosphere adjacent said bore hole.

22. The system of claim 21, further comprising a second coiled component situated adjacent and generally parallel to said first component, said second component is unreeled from said reel means into said bore hole with said first component.

23. The system of claim 22, wherein said second component is a generally hollow member containing conductor means therein, said second component providing means for enabling said anode and said conductor means to be readily removed when desired.

24. The system of claim 23, further comprising a third coiled component situated adjacent said first and said second component and extending from a point adjacent the mouth of said bore hole to a point adjacent the top end of said anode wherein said third component is unreeled from said reel means into said bore hole with said other components to further facilitate removal of said anode and said conductor means.

* * * * *